United States Patent [19]

Rolle et al.

[11] Patent Number: 4,473,604

[45] Date of Patent: Sep. 25, 1984

[54] METHOD OF KEEPING PARTS, ESPECIALLY MOTOR VEHICLE BODIES, WET DURING PREPARATION FOR PAINTING

[75] Inventors: Erwin Rolle, Dingolfing; Ferdinand Amberger, Bischofsmais, both of Fed. Rep. of Germany

[73] Assignee: Bayerische Motoren Werke AG, Munich, Fed. Rep. of Germany

[21] Appl. No.: 478,989

[22] Filed: Mar. 25, 1983

Related U.S. Application Data

[63] Continuation of Ser. No. 87,722, Oct. 24, 1979, abandoned.

[30] Foreign Application Priority Data

Oct. 27, 1978 [DE] Fed. Rep. of Germany ..... 2846932

[51] Int. Cl.[3] ..... B05D 3/00

[52] U.S. Cl. ..... 427/444; 427/315; 427/327

[58] Field of Search ..... 427/444, 435, 424, 421, 427/315, 327; 134/11, 31, 37; 29/81 B, 81 C; 118/423, 428, 425, 64, 58

[56] References Cited

U.S. PATENT DOCUMENTS

| | | | |
|---|---|---|---|
| 2,673,835 | 3/1954 | Kearney | 134/11 |
| 3,030,913 | 4/1962 | Arnold et al. | 134/11 |
| 3,042,547 | 7/1962 | Pickett | 134/11 |
| 3,049,133 | 8/1962 | Jacobs | 134/11 |
| 3,084,076 | 4/1963 | Loucks et al. | 134/31 |
| 3,705,817 | 12/1972 | Durr | 427/327 |
| 3,839,988 | 10/1974 | Duerr | 118/428 |
| 3,904,346 | 9/1975 | Shaw et al. | 427/315 |
| 4,186,032 | 1/1980 | Ham | 134/37 |

FOREIGN PATENT DOCUMENTS

| | | | |
|---|---|---|---|
| 1519724 | 8/1978 | United Kingdom | 427/435 |

*Primary Examiner*—Sadie L. Childs

*Attorney, Agent, or Firm*—Craig & Burns

[57] ABSTRACT

A method is disclosed for keeping a part such as a motor vehicle body wet between preparation stations during preparation for painting by placing the part in an atmosphere of wet vapor. In one embodiment, the part is placed in an enclosure between preparation stations, into which enclosure saturated vapor at a pressure of about 3.5 bars is introduced. The pressure within the chamber is essentially ambient pressure so that the pressurized saturated vapor expands to ambient pressure in the enclosure.

3 Claims, 1 Drawing Figure

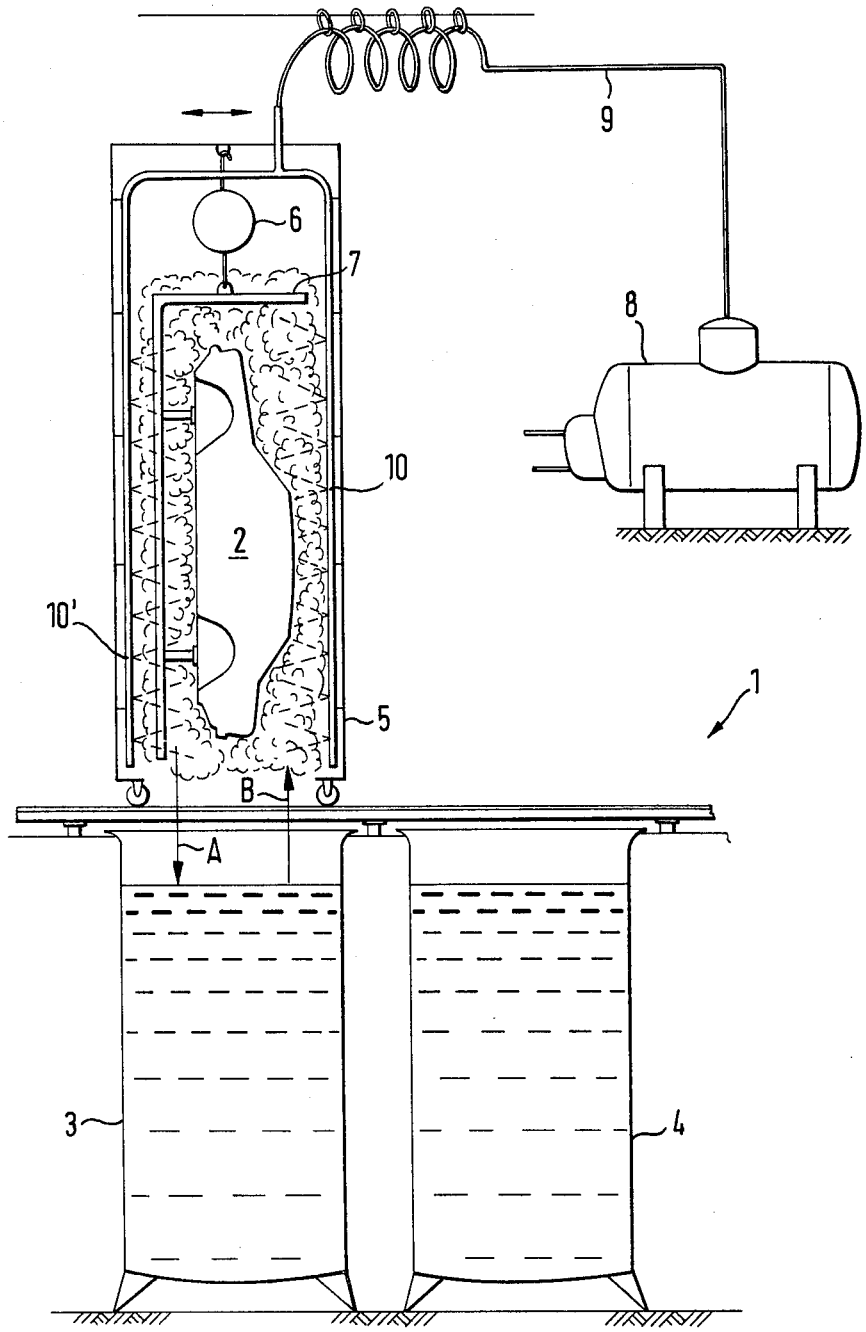
9
6
7
8
10
2
10'
1
5
B
A
3
4

METHOD OF KEEPING PARTS, ESPECIALLY MOTOR VEHICLE BODIES, WET DURING PREPARATION FOR PAINTING

This is a continuation of application Ser. No. 087,722, filed Oct. 24, 1979, now abandoned.

BACKGROUND AND SUMMARY OF THE INVENTION

The invention relates to a method of keeping a part such as a motor vehicle body wet between preparation stations during preparation for painting.

A method of preparing motor vehicle bodies for painting in a dippling arrangement is known, comprising a plurality of dipping tanks with different preparatory baths. Certain preparatory baths have temperatures considerably higher than ambient temperature. To transport the bodies between the dipping tanks, the bodies are placed in an enclosure which is open at the side facing the tanks and can travel above them.

The body, emerging from a bath at high temperature, is sprayed with water while in this enclosure, with spraying beginning as the body is withdrawn from the bath. The purpose of spraying is to keep the body wet, so that the heat absorbed by the body in the bath will not cause bath residues to dry or bake on.

The fact that spraying of the emergent body begins early means that relatively large amounts of water enter the preparatory bath, whereby the chemical composition of the latter is altered disadvantageously. The spray water causes the bath contents to overflow frequently in a dipping arrangement of the type described above employed for mass production, whereby a portion of the heated bath contents together with the chemicals is lost.

Accordingly, an object of the present invention is to improve the method of keeping parts such as motor vehicle bodies wet during preparation for painting in the manner described above in such a way that this system can be operated more economically and especially more cheaply.

This object is achieved according to the present invention by placing the part and/or body in a wet vapor atmosphere.

In a preferred embodiment of the present invention, a saturated vapor is used which forms wet vapor when it expands to the pressure of the air surrounding the part or body, said wet vapor sufficing to keep the part or body wet. Advantageously, this means that only small amounts of foreign liquid can enter the bath over a long period of time, thus avoiding overflow of the bath. Since the bath is prevented from overflowing, the associated heat losses are eliminated, permitting, on the one hand, more uniform temperature control of the bath contents and, on the other hand, a saving of energy.

Preventing the bath from overflowing has the additional advantage that the contents of the bath maintain their chemical composition practically unchanged over a long space of time. As a result, the consumption of chemicals per bath and part or body is considerably reduced in a mass-production dipping installation.

Accordingly, the present invention allows a considerable decrease in operating costs by saving operating means and energy.

These and other objects, features and advantages of the present invention will become more obvious from the following description when taken in connection with the accompanying drawings which show for purposes of illustration only a single embodiment in accordance with the present invention.

BRIEF DESCRIPTION OF THE DRAWINGS

The single drawing FIGURE is a schematic side view, partly in cross section of a dipping facility for preparing a car body for painting according to the present invention.

DETAILED DESCRIPTION OF THE DRAWING

The dipping facility 1 in the drawing is for preparing an unfinished passenger-car body 2 for painting. Dipping facility 1 comprises a dipping tank 3 for a degreasing bath for body 2, as well as a dipping tank 4 for a subsequent rinsing bath for body 2. The degreasing bath is kept, for example, at a temperature of about 80° C.

Dipping facility 1 also comprises an enclosure 5 which is open at the side facing the tanks and can move back and forth a short distance above dipping tanks 3 and 4. A hoist 6 is provided in enclosure 5, from which a support 7 to hold body 2 is suspended. Hoist 6 lowers body 2 on support 7 in the direction of arrow "A" into the degreasing bath in dipping tank 3.

After remaining in the degreasing bath for a predetermined space of time, body 2 is drawn up again in the direction of arrow "B" into enclosure 5 to be transported to the adjacent rinsing bath in dipping tank 4. After one or more rinsing baths, a phosphate bath, followed by a rinsing bath in dipping tanks, not shown, can be provided to further prepare body 2 for painting. The temperature of the phosphate bath can be approximately the same as that of the degreasing bath.

In order to prevent any bath residues on body 2 emerging from heated degreasing or phosphate baths from drying or baking onto the hot body 2, body 2 must be kept wet. Vapor, preferably steam, is used for this purpose. The latter can be produced in the form of saturated vapor in an evaporator 8, from which a line 9 runs to vapor outlet pipes 10, 10' disposed in enclosure 5. The saturated vapor, at a pressure of 3.5 bars, for example, turns into wet vapor when it expands to the pressure of the ambient air in enclosure 5 and forms a film of moisture on body 2. The film of moisture therefore prevents any bath residues from drying until body 2 is immersed in the following rinse bath in the next dipping tank, dipping tank 4, after being degreased in dipping tank 3. Since cavities and/or parts of the body which are difficult of access are reached more reliably by vapor than by conventional spraying with water, the bath residues in these areas as well are kept liquid, and will be floated away in the rinse bath. Hence, this method of keeping body 2 or a part wet by using vapor results in a qualitative improvement in preparation for painting.

While we have shown and described one embodiment in accordance with the present invention, it is understood that the same is not limited thereto but is susceptible to numerous changes and modifications as known to those skilled in the art and we therefore do not wish to be limited to the details shown and described herein but intend to cover all such changes and modifications as are encompassed by the scope of the appended claims.

We claim:

1. A method for keeping an unfinished motor vehicle body wet between pretreatment baths, having aqueous solutions, using in a painting pretreatment process, comprising successively introducing the unfinished motor vehicle body into a plurality of pretreatment tanks containing, in succession, a heated pretreatment bath and an immersion-rinse bath; conveying the unfinished motor vehicle body between the pretreatment tanks within an enclosure open toward the preteatment tanks and arranged to move above the pretreatment tanks; keeping the motor vehicle body wet in ambient air within said enclosure between the successive petreatment tanks, the motor vehicle body being essentially warmer than the ambient air within said enclosure, generating a wet-vapor atmosphere in the ambient air within said enclosure by expanding an essentially saturated water vapor a portion of said water vapor saturates the ambient air within said enclosure to maximum humidity whereby said water vapor condenses into wet vapor keeping the relatively warm vehicle body wet between the pretreatment tanks.

2. The method according to claim 1, wherein the steam produced into said enclosure is a saturated steam at a pressure of about 3.5 bars.

3. The method according to claim 1, wherein said pretreatment bath is maintained at an elevated temperature.

* * * * *